United States Patent [19]

Keeffe et al.

[11] 4,308,483

[45] Dec. 29, 1981

[54] HIGH BRIGHTNESS, LOW WATTAGE, HIGH PRESSURE, METAL VAPOR DISCHARGE LAMP

[75] Inventors: William M. Keeffe, Rockport; Harold L. Rothwell, Jr., Rowley; George J. English, Reading; W. Calvin Gungle, Danvers, all of Mass.

[73] Assignee: GTE Products Corporation, Stamford, Conn.

[21] Appl. No.: 132,934

[22] Filed: Mar. 24, 1980

[51] Int. Cl.[3] ..... H01J 61/30; H01J 61/33; H01J 61/20

[52] U.S. Cl. ..... 313/214; 313/185; 313/223; 313/229

[58] Field of Search ..... 313/183–185, 313/214, 217, 220–221, 223–229, 283–286, 290, 335, 357

[56] References Cited

U.S. PATENT DOCUMENTS 4,001,623 1/1977 Howles et al. ..... 313/217 X
4,161,672 7/1979 Cap et al. ..... 313/214 X

*Primary Examiner*—Marvin L. Nussbaum
*Attorney, Agent, or Firm*—William H. McNeill

[57] ABSTRACT

A single ended, short arc, low wattage, high pressure, metal vapor discharge lamp is electrode stabilized and employs arc constrictors selected from the group of lanthanides, actinides and thorium to provide a brightness of 175,000 cd/in$^2$ when operated at 75 watts.

5 Claims, 2 Drawing Figures

HIGH BRIGHTNESS, LOW WATTAGE, HIGH PRESSURE, METAL VAPOR DISCHARGE LAMP

TECHNICAL FIELD

This invention relates to short arc, low wattage, high pressure metal vapor discharge lamps of the single ended variety and more particularly to such lamps having high brightness.

BACKGROUND ART

Single ended short arc lamps of low wattage previously employed have had brightness levels of 12,750 cd/in$^2$ (candela per square inch) to 22,625 cd/in$^2$ when operated over the range of 50 to 75 watts. These brightness levels correspond to those obtainable from commercially available tungsten-halogen incandescent lamps rated at 150 watts. High brightness lamps, including the tungsten-halogen incandescent described above, short arc mercury lamps and short arc Xenon lamps are used in projection systems and for theater and studio lighting. The short arc mercury lamps can achieve brightness levels of 139,000 cd/in$^2$ and the short arc xenon lamps can achieve brightness levels of 278,000 cd/in$^2$ or more. The latter two of these lamps, however, are double ended; i.e., the electrodes of the lamps are arrayed along a single longitudinal axis. Lamps of this type, for example, a low wattage (i.e., 100 watts) short arc xenon lamps can have a length of 78 mm for an arc length of 0.55 mm and a brightness level of about 161,300 cd/in$^2$.

It would be an advance in the art to provide a single ended, short arc lamp having a size much smaller than that of the mercury or xenon lamps and with equivalent brightness levels.

DISCLOSURE OF INVENTION

It is an object of the invention to obviate the disadvantages of the prior art.

It is another object of the invention to provide a lamp of small size and increased brightness.

These objects are accomplished, in one aspect of the invention, by the provision of a single ended, high pressure, low wattage, metal vapor discharge lamp which includes a pair of electrodes whose terminal ends define an arc region having a given distance therebetween. This given distance is substantially equal to the distance of the terminal ends of the electrodes from at least one wall of the arc chamber.

The arc generating and sustaining medium or fill includes mercury, a starting gas and an arc constrictor selected from the group of lanthanides, actinides and thorium and is noted by a complete absence of alkali metals.

Lamps constructed in accordance with the above occupy a very small volume relative to other high brightness, short arc lamps yet produce brightness levels from 80,000 cd/in$^2$ to 175,000 cd/in$^2$ when operated over the range of 50 to 75 watts.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
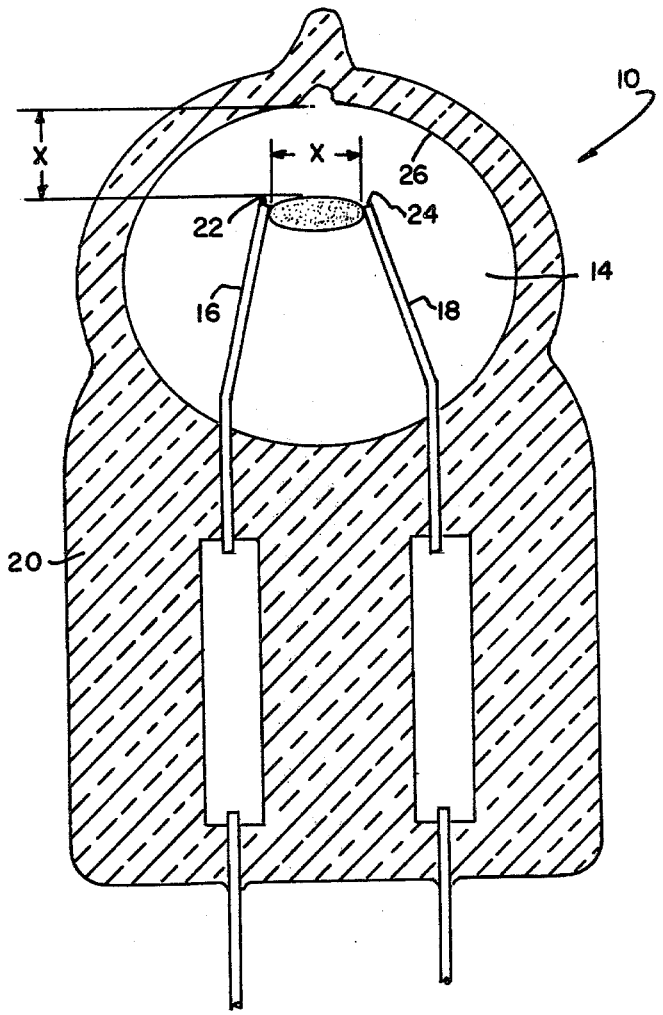
FIG. 1 is an elevational sectional view of a lamp of the invention.

Referring now to the drawings with greater particularity, there is shown in FIG. 1 a single ended, short arc lamp 10 having a transparent body 12 of, for example, quartz, which defines an arc chamber 14. Lamp 10 can have an overall height of about 18 mm, a width of about 13 mm and a thickness of about 6 mm. The arc chamber preferably occupies a volume of about 0.2 cm$^3$ to 0.4 cm$^3$ with about 0.3 cm$^3$ being preferred. Adjacent first and second electrodes 16 and 18 are conventionally sealed into an end 20 of lamp 10 and terminate within arc chamber 14. The terminal ends 22 and 24 respectively of electrodes 16 and 18 define the arc region of the lamp and are separated by a distance which equals the arc length.

The chamber 14 is so formed as to provide at least one wall, in this instance the upper surface 26, whose distance from the ends 22 and 24 of electrodes 16 and 18 is substantially equal to x. This construction provides a lamp that is effectively electrode stabilized and eliminates the need to employ alkali metal arc fatteners which are necessary in wall stabilized metal halide lamps.

In addition, lamp 10 includes an arc generating and sustaining medium or fill which includes at least one arc constrictor selected from the group of lanthanides, actinides and thorium, as well as mercury, iodine, scandium and argon.

The arc constrictor should be present in an amount of about 0.1 mg/0.1 cm$^3$ of arc chamber volume, with a slight excess over this ratio being preferred.

In a specific, but non-limiting, example, an arc lamp of the instant variety had an arc chamber volume of about 0.3 cm$^3$ and a distance x equal to about 1.5 mm. The fill included about 14.95 mg of mercury to achieve an arc voltage of about 50 V., about 0.45 mg iodine and 0.3 mg scandium (which during lamp operation forms scandium iodide and provides color correction) and about 0.3 mg thorium as an arc constrictor, and argon at a pressure of about 200 torr.

Figure 2:
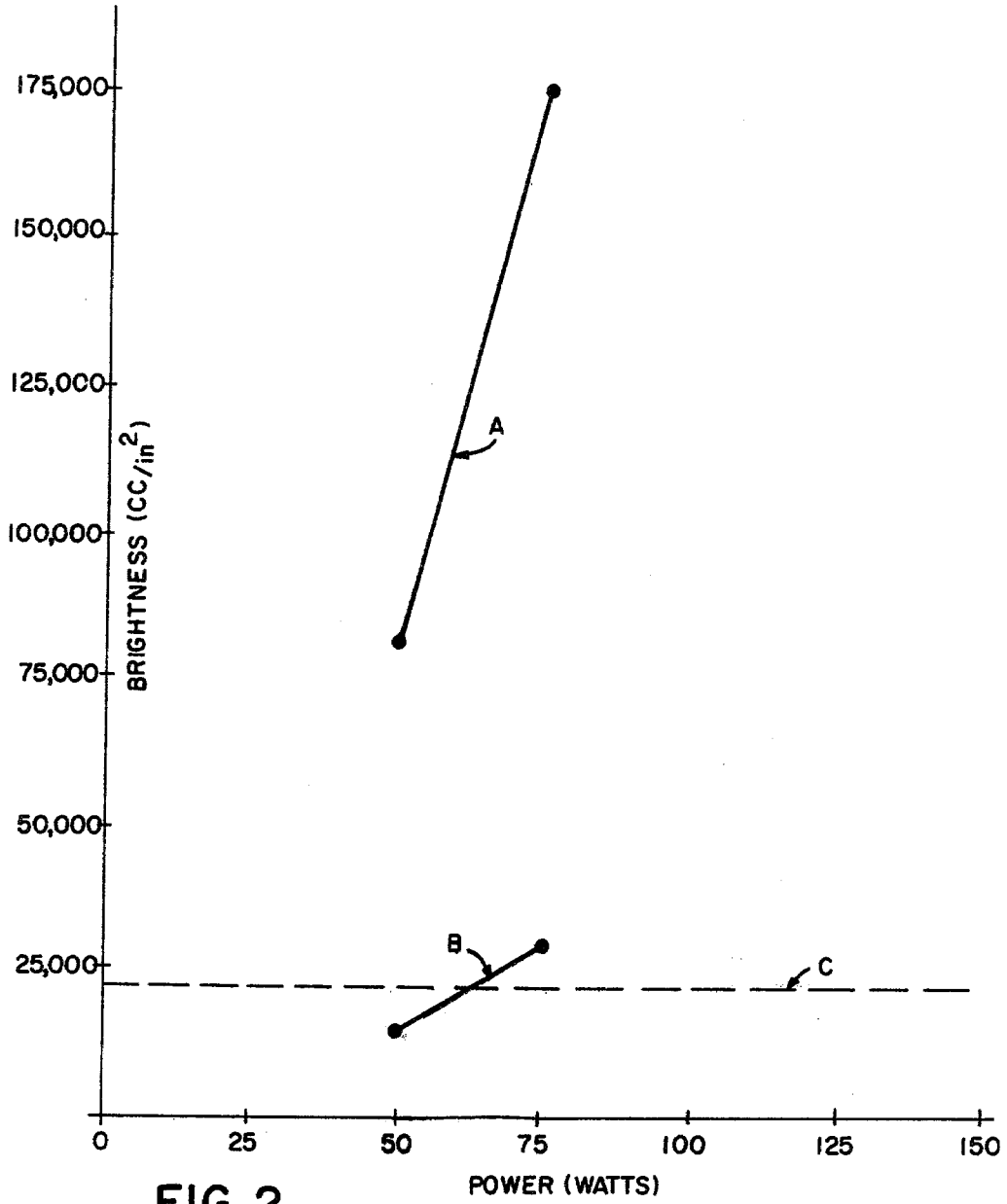
FIG. 2 is a graph of power versus brightness plots for some prior art lamps and the lamp of the invention.

Ideally suited for alternating current operation with its symmetrically formed electrodes 16 and 18, this lamp produced the brightness levels shown by plot A in FIG. 2. As can be seen therefrom lamp 10 produced brightness levels from 80,000 cd/in$^2$ to 175,000 cd/in$^2$ when operated at from 50 to 75 watts.

Brightness levels between 75000 and 100,000 cd/in$^2$ are preferable for projection lamps in order to provide reasonable electrode life and an arc having adequate thickness to insure satisfactory optical alignment tolerances.

For comparison, plot B of FIG. 2 illustrates the brightness levels of a prior art single ended lamp not constructed in accordance with the teachings of this invention.

The dashed line, plot C, indicates the brightness of a commercially available tungsten-halogen incandescent lamp of a type known as FCS and rated for 150 watts.

The compact lamp of this invention provides a clear improvement over similar prior art lamps and has brightness levels approaching and in some cases exceeding those available with the much larger and cumbersome short arc mercury and xenon lamps operated at the same power ratings.

While there have been shown and described what are at present considered to be the preferred embodiments of the invention, it will be apparent to those skilled in the art that various changes and modifications can be made herein without departing from the scope of the invention as defined by the appended claims.

We claim:

1. A single ended, high pressure, low wattage, metal vapor discharge lamp having a transparent body defining an arc chamber and containing an arc generating and sustaining medium; adjacent first and second electrodes sealed in said body and projecting into said arc chamber, the terminal ends of said electrodes defining an arc region, said lamp being characterized by: the distance between said terminal ends being substantially equal to the distance of said terminal ends from an upper surface of said arc chamber, and an arc generating and sustaining medium comprising an effective amount of mercury to achieve the predetermined arc voltage; an arc constrictor selected from the group of lanthanides, actinides and thorium; a halide; and a complete absence of alkali metals.

2. The lamp of claim 1 wherein said arc constrictor is thorium.

3. The lamp of claim 2 wherein said arc chamber has a volume of about 0.2 $cm^3$ to 0.4 $cm^3$.

4. The lamp of claim 3 wherein said arc voltage is about 50V.

5. The lamp of claim 3 wherein said arc generating and sustaining medium comprises about 14.95 mg mercury, 0.45 mg iodine, 0.3 mg scandium, and 0.3 mg thorium.

* * * * *